US007159799B2

(12) United States Patent
Cooke

(10) Patent No.: US 7,159,799 B2
(45) Date of Patent: Jan. 9, 2007

(54) FUEL INJECTOR

(75) Inventor: Michael Peter Cooke, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/332,642

(22) Filed: Jan. 13, 2006

(65) Prior Publication Data

US 2006/0157594 A1 Jul. 20, 2006

(51) Int. Cl.
*F02M 61/00* (2006.01)

(52) U.S. Cl. ..... 239/533.12; 239/533.2; 239/533.11; 239/533.9; 239/533.4; 239/102.2

(58) Field of Classification Search ..... 239/533.2, 239/533.3, 533.4, 533.5, 533.6, 533.7, 533.8, 239/533.9, 533.11, 533.12
See application file for complete search history.

(56) References Cited

U.S. PATENT DOCUMENTS

| | | | | |
|---|---|---|---|---|
| 4,382,554 | A * | 5/1983 | Hofmann | 239/533.9 |
| 6,338,445 | B1 * | 1/2002 | Lambert et al. | 239/533.12 |
| 6,513,733 | B1 * | 2/2003 | Lambert | 239/533.1 |
| 6,520,145 | B1 * | 2/2003 | Hunkert | 123/305 |

FOREIGN PATENT DOCUMENTS

| | | |
|---|---|---|
| DE | 10315820 | 5/2004 |
| DE | 10315821 | 5/2004 |
| DE | 10254186 | 6/2004 |
| DE | 10306808 | 9/2004 |
| DE | 10322826 | 12/2004 |
| EP | 0967383 | 12/1999 |
| EP | 1063415 | 12/2000 |
| EP | 1344929 | 9/2003 |

* cited by examiner

*Primary Examiner*—Dinh Q. Nguyen
(74) *Attorney, Agent, or Firm*—David P. Wood

(57) ABSTRACT

A fuel injector for an internal combustion engine has a nozzle body (36) provided with a nozzle bore (42), an inner valve (16) which is engageable with an inner valve seating (48) to control fuel delivery through one or more first nozzle outlets (38), and an outer valve (18) which is received within the nozzle bore (42) and engageable with an outer valve seating (48) to control fuel delivery through one or more second nozzle outlets (40). An actuator (14) for controlling movement of the inner and outer valves (16, 18) transmits an actuation force to the valves (16, 18) so as to permit either movement of the inner valve (16) only to provide a first injection state in which fuel is delivered through only the or each of the first outlets (38), or movement of the outer valve (18) only to provide a second injection state in which fuel is delivered through only the or each of the second outlets (40). A coupling means (54, 54*a*, 52*d*) is provided for coupling movement of the outer valve (18) to the inner valve (16) in circumstances in which the outer valve (18) is moved away from the outer valve seating (48) through an amount exceeding a predetermined threshold amount, thereby to cause the inner valve (16) to lift away from the inner valve seating (48) to provide a third injection state in which fuel is delivered through both the first and the second nozzle outlets (38, 40) together.

25 Claims, 8 Drawing Sheets

FUEL INJECTOR

Figure 1:
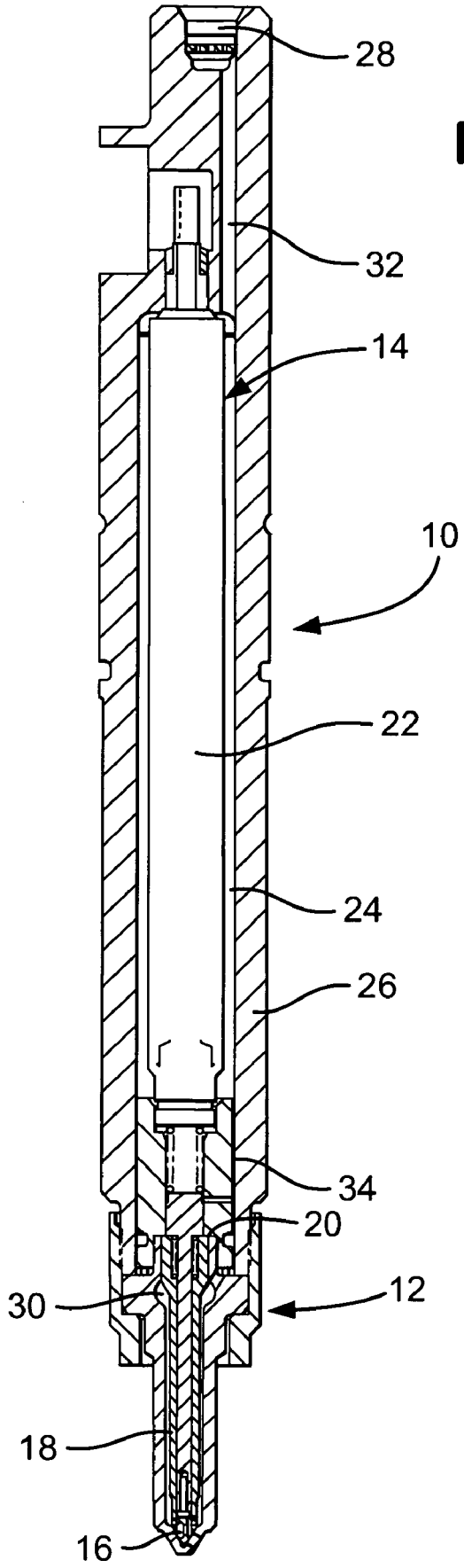

The present invention relates to a fuel injector for an internal combustion engine. In particular, the injector includes an inner valve needle arranged concentrically within an outer valve, each of the needles controlling the delivery of fuel into the combustion chamber of an internal combustion engine.

It is known to provide a fuel injector with an injection nozzle, commonly referred to as a variable orifice nozzle (VON), in which a nozzle body is provided with a blind bore within which a first, outer valve is movable under the control of an actuator. The bore provided in the nozzle body defines a seating surface with which the outer valve is engageable to control fuel delivery through a first set of nozzle outlets provided at a first axial position along the length of the nozzle body. The outer valve is itself provided with a further bore within which a second, inner valve needle is able to move. The inner valve needle projects through the open end of the further bore in the outer valve and is engageable with the seating surface to control fuel delivery through a second set of outlets provided at a second, lower axial height along the length of the nozzle body.

The outer valve is operable either to move alone, so that the outer valve is lifted away from its seating but the inner valve needle remains seated, or so as to cause the inner valve needle to move also. Movement of the outer valve is transmitted to the inner valve needle, causing the inner valve needle to lift too, in circumstances in which the outer valve is moved through an amount exceeding a predetermined threshold amount. During this stage of operation, both the first and second sets of outlets are opened to give a relatively high fuel delivery rate. If the outer valve is lifted through an amount less than the predetermined threshold amount, the inner valve needle remains seated so that injection only occurs through the first set of outlets at a lower fuel delivery rate. An injection nozzle of this type is described in the Applicant's European Patent EP 0967382 (Delphi Technologies Inc.), or in the Applicant's co-pending European Patent Application EP 1555430 A (Delphi Technologies Inc.).

Variable orifice nozzles of the aforementioned type provide particular advantages for diesel engines, in that they provide the flexibility to inject fuel into the combustion chamber either through the first set of outlets on its own or through both the first and second outlets together. This enables selection of a fuel spray having a larger total fuel delivery area for high engine power modes or a smaller total fuel delivery area for lower engine power modes.

It has now been recognised that for certain applications it would be desirable to provide a wider range of fuel delivery sprays; the facility to inject just two different spray formations is limiting in some cases. Furthermore, in engines that operate in different combustion modes, for example in both Homogeneous Charge Compression Ignition (HCCI) and conventional diesel modes, it is desirable to be able to have different fuel sprays in different modes. For HCCI operation where injection occurs early before the piston is at the top of its stroke, there are benefits to having a downwardly directed fuel spray of relatively narrow cone angle (typically 80 degrees included cone angle), whereas conventional diesel modes benefit from a wider fuel spray (typically 150 degrees included cone angle) directed outwardly. For high load operation with injection occurring through both sets of outlets the sprays will interfere with one another, resulting in reduced momentum and the HCCI sprays hitting the piston.

As a compromise, fuel spray angles can be selected to avoid these problems but performance is not then optimum for either mode.

It is with a view to addressing the aforementioned issues that an improved injector is provided by the present invention.

According to a first aspect of the invention, there is provided a fuel injector for an internal combustion engine, comprising a nozzle body provided with a nozzle bore, an inner valve which is engageable with an inner valve seating to control fuel delivery through one or more first nozzle outlets and an outer valve which is received within the nozzle bore and engageable with an outer valve seating to control fuel delivery through one or more second nozzle outlets. A means is provided for controlling movement of the inner and outer valves, including an actuator for transmitting an actuation force to the inner and outer valves so as to permit movement of either the inner valve only, to provide a first injection state in which fuel is delivered through the or each of the first outlets only, or movement of the outer valve only, to provide a second injection state in which fuel is delivered through the or each of the second outlets only. The injector further includes a coupling means for coupling movement of the outer valve to the inner valve in circumstances in which the outer valve is moved away from the outer valve seating through an amount exceeding a predetermined threshold amount, thereby to cause the inner valve to lift away from the inner valve seating also to provide a third injection state in which fuel is delivered through both the first and the second nozzle outlets together.

The invention is particularly suitable for use in a common rail fuel injection system in which a common rail supplies fuel at rail pressure to the injector, and to a plurality of other injectors of the system also.

The invention therefore provides the advantage that three different fuel sprays, or fuel injection rates, may be achieved, depending on whether the first, second or third injection state is selected. This provides an advantage over known fuel injectors in which only two injection rates are possible (i.e. either a relatively low injection rate which is achieved by injecting through one set of outlets or a relatively high injection rate which is achieved by injecting through both sets of outlets together). In the present invention, small medium and large outlet areas are made possible, for operation at low, medium and high loads respectively. Furthermore, in engines that operate in different combustion modes, for example with both HCCI and conventional diesel modes, it is desirable to be able to have different fuel sprays in different modes. An injector having the ability to inject in one of three injection states, as provided here, therefore has advantages when implemented in applications of this type.

In a preferred embodiment, the injector includes a control chamber for fuel for transmitting the actuation force to the inner and outer valves, a first surface associated with the inner valve being exposed to fuel pressure within the control chamber and a second surface associated with the outer valve being exposed to fuel pressure within the control chamber.

In a further preferred embodiment, the first and second surfaces are arranged such that an increase in fuel pressure within the control chamber causes one of the inner or outer valves to lift and a decrease in fuel pressure within the control chamber causes the other of the inner or outer valves to lift.

It is preferable for the control chamber to be configured relative to the inner and outer valves so that an increase in fuel pressure within the control chamber results in the inner valve being opened and a decrease in fuel pressure within the control chamber results in the outer valve being opened.

In a preferred embodiment, the outer valve is provided with a valve bore within which the inner valve is received, the inner valve being coupled to a carrier member which extends through the valve bore to define the first surface. The carrier member may be provided with an enlarged head, at its end remote from the inner valve, wherein a lower surface of the enlarged head defines the first surface.

The coupling means preferably includes an abutment surface defined by, and/or movable with, the outer valve, wherein the abutment surface is engageable with a co-operable surface defined by the carrier member.

Preferably, the abutment surface is defined by an annular member received within the valve bore, for example in an interference fit. The annular member is spaced from the carrier member by the predetermined threshold amount in circumstances in which both valves are seated.

The actuator is preferably a piezoelectric actuator including a stack of piezoelectric elements. It is preferable to locate the piezoelectric stack within a stack chamber for receiving fuel at injection pressure. The stack is energisable so as to increase the stack length and thereby to increase pressure within the control chamber, and de-energisable to decrease the stack length so as to decrease pressure within the control chamber.

In a preferred embodiment, the actuator is coupled to an actuator piston having a piston surface, wherein the control chamber is defined, at least in part, by the first and second surfaces associated with the inner and outer valves, respectively, and by the piston surface.

In a further preferred embodiment, the injector includes a damping means for damping opening movement of the inner valve as it moves away from the inner valve seating.

The injector typically includes a spring chamber housing a spring which serves to bias the inner valve towards the inner valve seating. Preferably, the damping means includes a restricted passage defined within the actuator piston, which connects the spring chamber to the stack chamber.

The injector may further comprise restrictive flow means for connecting the control chamber to the stack chamber. As a result, there is a tendency for fuel pressure within the control chamber to equalise with injection pressure when the injector is in a non-injecting state. As control chamber pressure tends to track pressure within the stack chamber, all forces remain proportional to injection pressure and any rapid changes in fuel pressure within the rail will not result in an unwanted injection. A further advantage of the restrictive flow means is that, if the actuator fails, the flow through the restrictive flow means will allow the needle to close by itself. Additionally, by allowing the control chamber to see a 'fresh' flow of fuel, degradation of fuel within the control chamber is avoided.

Preferably, the restrictive flow means is provided by a restricted flow passage provided in the actuator piston.

In a further preferred embodiment, the outer valve is provided with upper and lower seating lines, spaced one on either side of the second outlets in circumstances in which the outer valve is seated, wherein the upper and lower seating lines are engageable with respective upper and lower seats of the outer valve seating.

Likewise, the inner valve may be provided with upper and lower seating lines, spaced one on either side of the first outlets in circumstances in which the inner valve is seated, wherein the upper and lower seating lines are engageable with upper and lower seats, respectively, of the inner valve seating.

For example, the upper and lower seating lines of the inner valve may be defined by upper and lower edges, respectively, of a groove provided on the inner valve, said groove comprising an upper groove region of frusto-conical form to define the upper edge and a lower groove region of frusto-conical form to define the lower edge.

Likewise, the upper and lower seating lines of the outer valve may be defined by upper and lower edges, respectively, of a groove provided on the outer valve, said groove comprising an upper groove region of frusto-conical form to define the upper edge and a lower groove region of frusto-conical form to define the lower edge.

Preferably, the nozzle bore defines an upper delivery chamber for delivering fuel to the first and second outlets and a lower delivery chamber for delivering fuel to the first and second outlets. The inner valve defines, at least in part, a flow passage means to allow fuel to flow from the upper delivery chamber towards the lower delivery chamber.

Preferably, the flow passage means includes one or more flats provided on the outer surface of the inner valve.

In a further preferred embodiment, the or each first outlet has a different cross sectional flow area compared with the or each second outlet. For example, the first outlets may have a larger cross sectional flow area compared with the second outlets. In this way, it is possible to achieve three different fuel sprays and injection rates.

According to a second aspect of the invention, a fuel injector for an internal combustion engine includes an inner valve which is engageable with an inner valve seating to control fuel delivery through one or more first nozzle outlets and an outer valve which is engageable with an outer valve seating to control fuel delivery through one or more second nozzle outlets. An actuator transmits an actuator force to the inner and outer valves so as to permit movement of either the inner valve only to provide a first injection state in which fuel is delivered through only the or each of the first outlets, or movement of the outer valve only to provide a second injection state in which fuel is delivered through only the or each of the second outlets. A coupling arrangement couples movement of the outer valve to the inner valve in circumstances in which the outer valve is moved away from the outer valve seating through an amount exceeding a predetermined threshold amount so as to cause the inner valve to lift away from the inner valve seating to provide a third injection state in which fuel is delivered through both the first and the second nozzle outlets together, wherein the outer valve is provided with a valve bore within which the inner valve is received. A damping arrangement damps opening movement of the inner valve away from the inner valve seating.

According to a third aspect of the invention, there is provided a fuel injector for an internal combustion engine comprising an inner valve which is engageable with an inner valve seating to control fuel delivery through one or more first nozzle outlets and an outer valve which is engageable with an outer valve seating to control fuel delivery through one or more second nozzle outlets. The injector has a control chamber for fuel, a first surface associated with the inner valve being exposed to fuel pressure within the control chamber and a second surface associated with the outer valve having a second surface exposed to fuel pressure within the control chamber. An actuator transmits an actuation force to the inner and outer valves, via the control chamber, so as to permit movement of either the inner valve only to provide a first injection state in which fuel is delivered through only the or each of the first outlets or movement of the outer valve only to provide a second injection state in which fuel is delivered through only the or each of the second outlets. There is a coupling between the outer valve and the inner valve so that, in circumstances in which the outer valve is moved away from the outer valve seating through an amount exceeding a predetermined threshold amount, the inner valve is caused to move too, thereby to provide a third injection state in which fuel is delivered through both the first and the second nozzle outlets together.

It will be appreciated that the preferred and/or optional features of the first aspect of the invention may be incorporated alone or in appropriate combination in the second or third aspects of the invention also.

Figure 2:
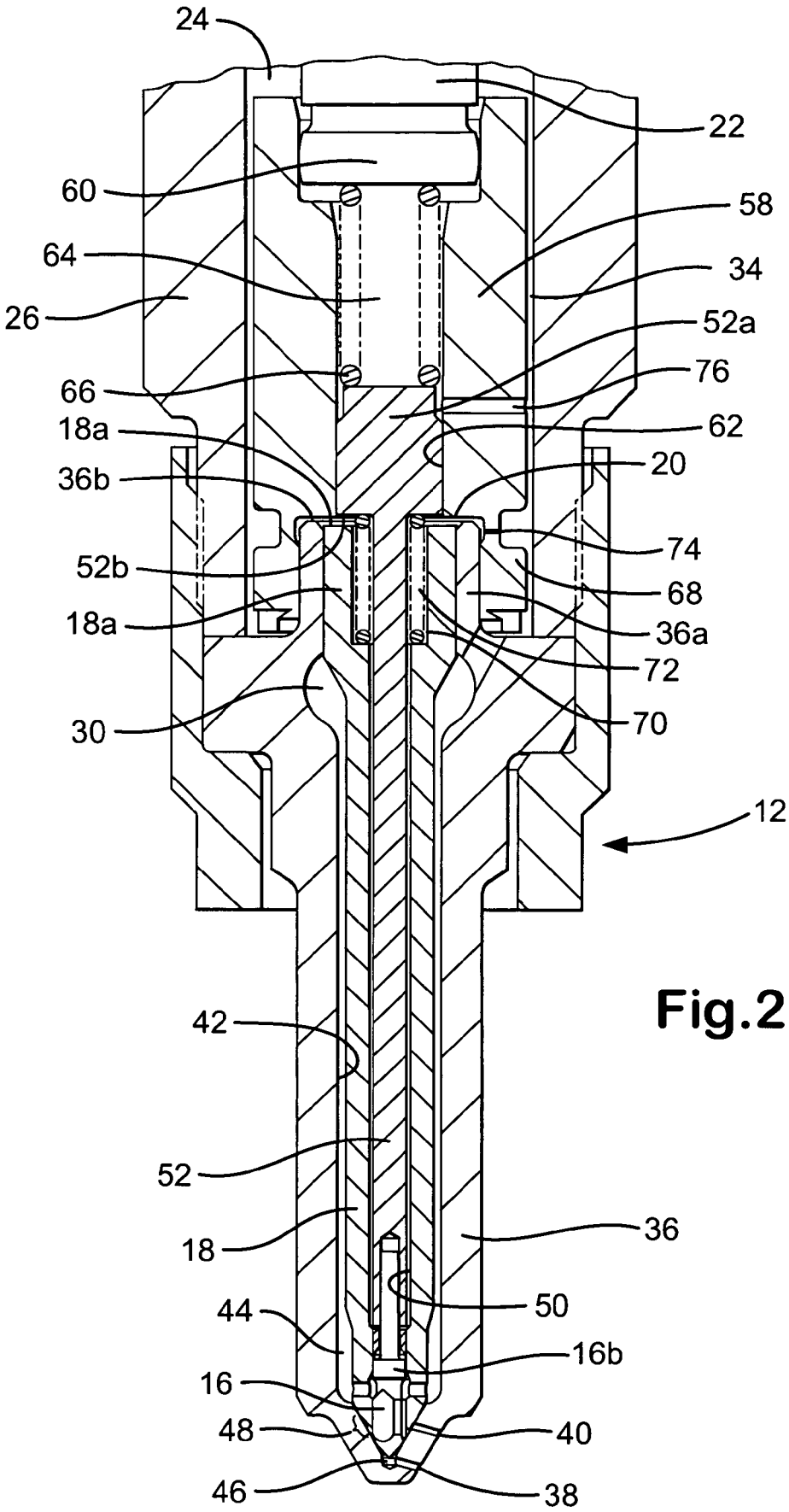
Figure 3:
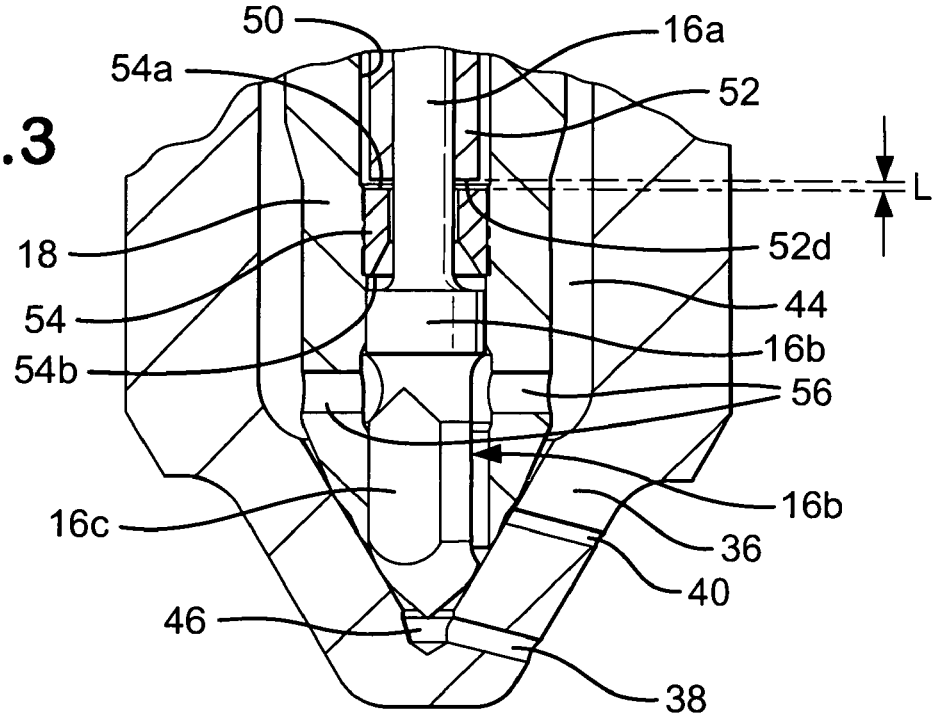
Figure 4:
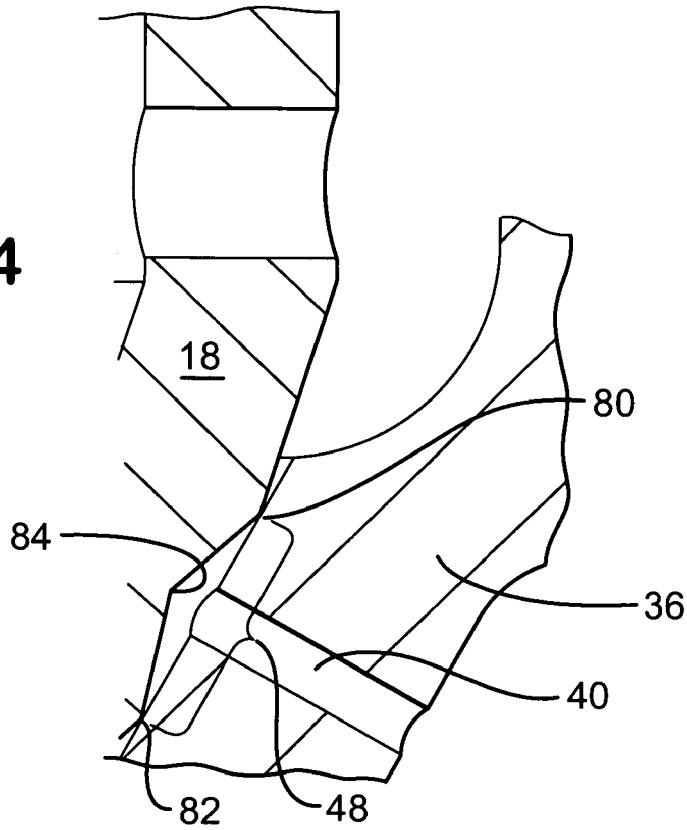
Figure 5:
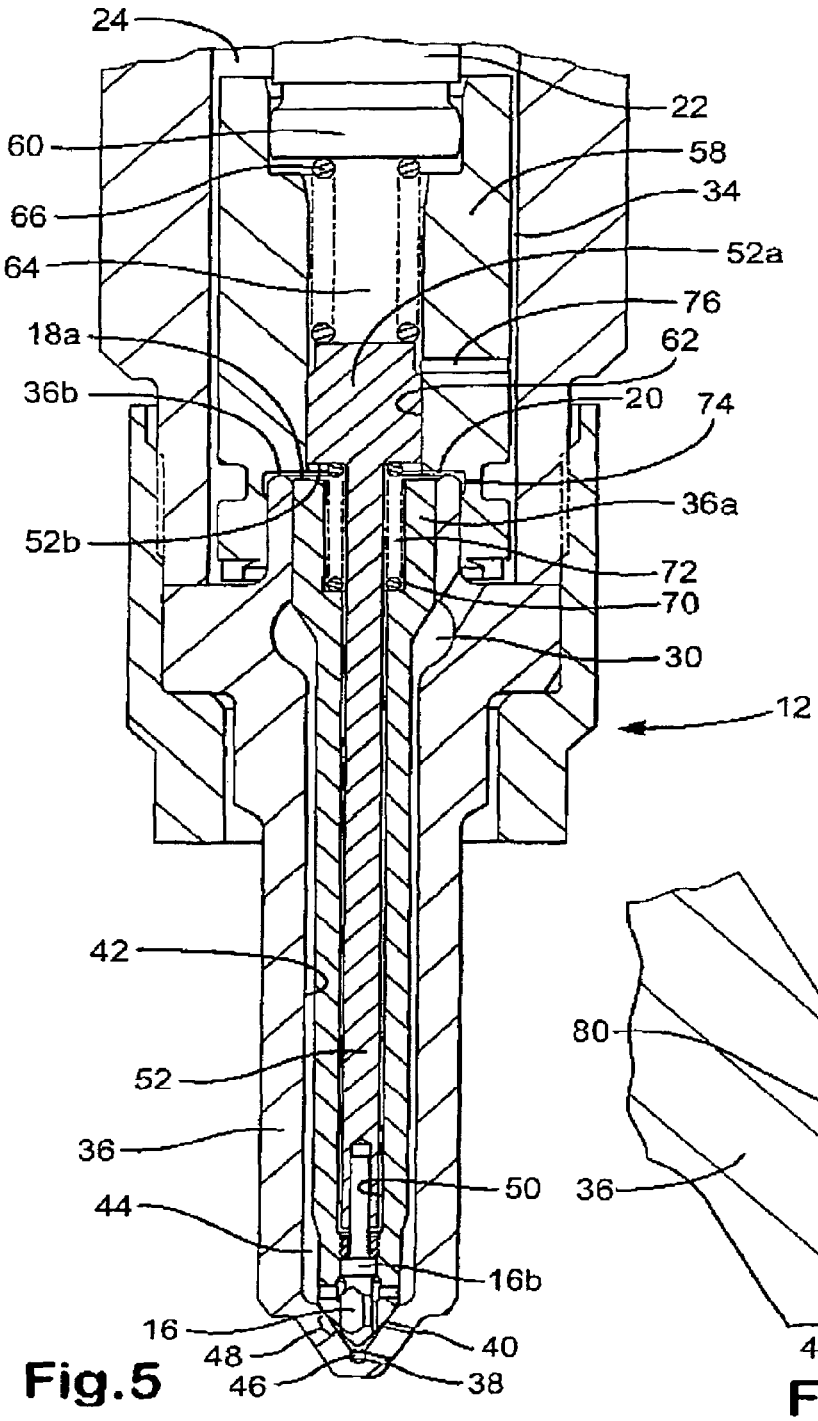
Figure 5A:
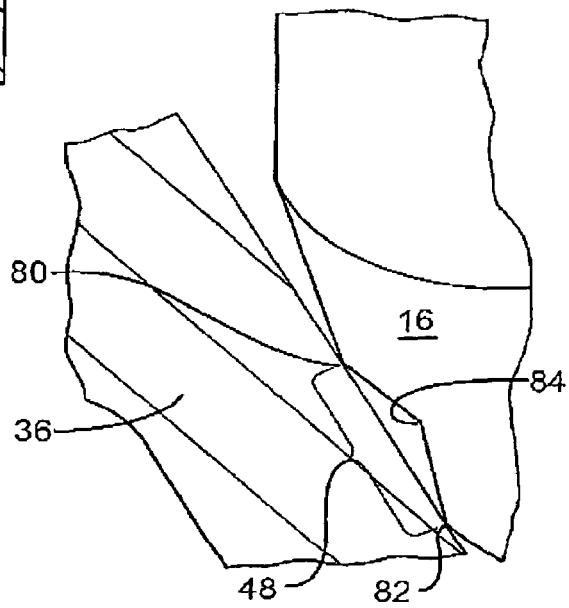
Figure 6:
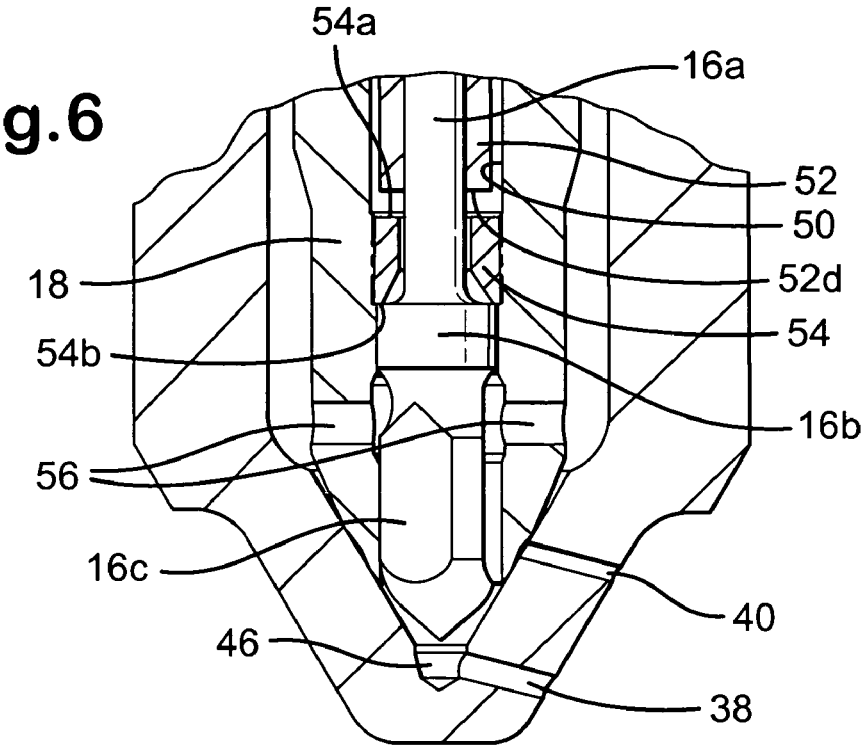
Figure 8:
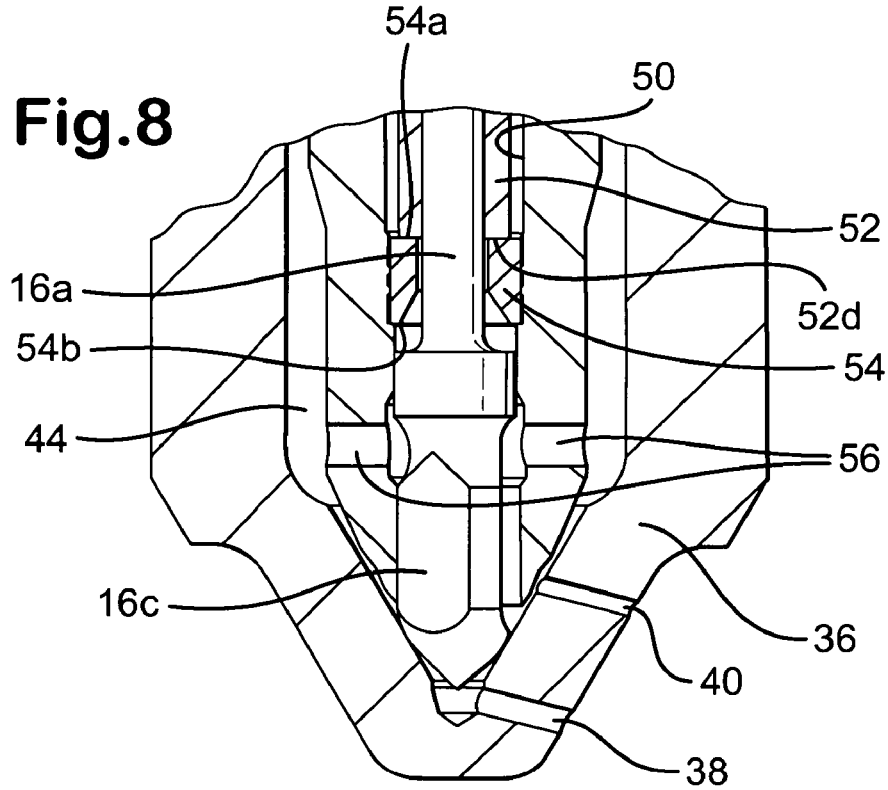
Figure 7:
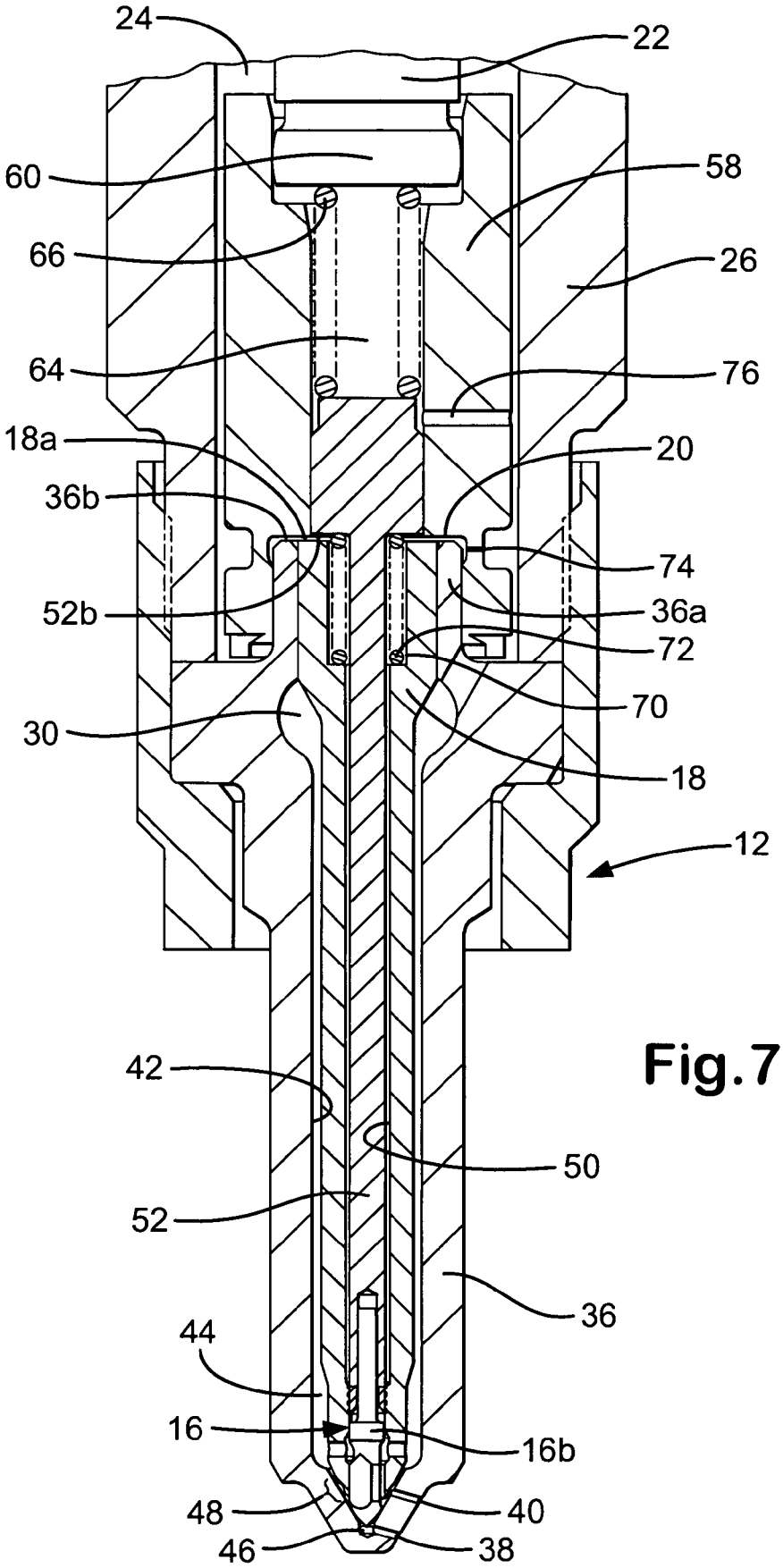
Figure 9:
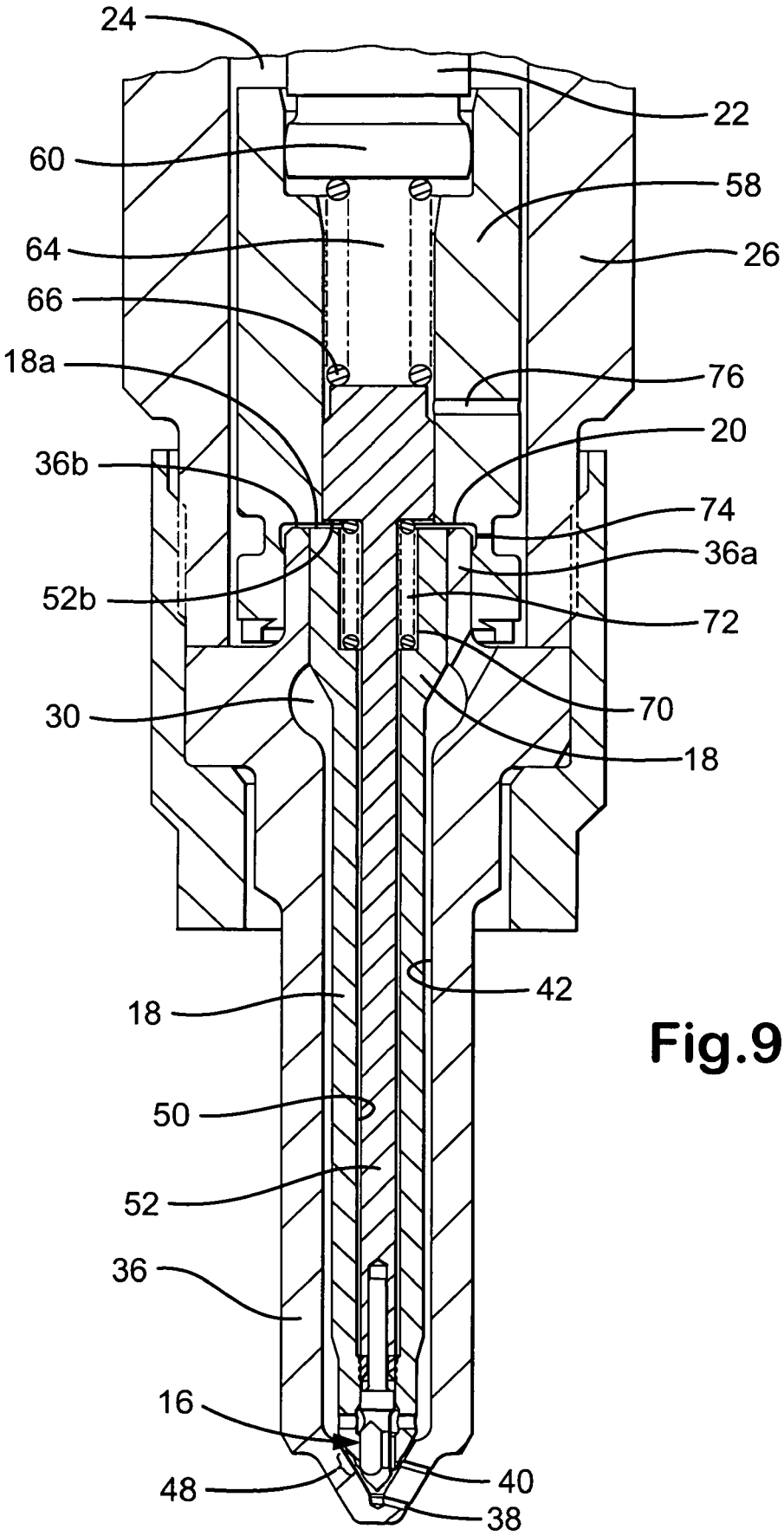
Figure 10:
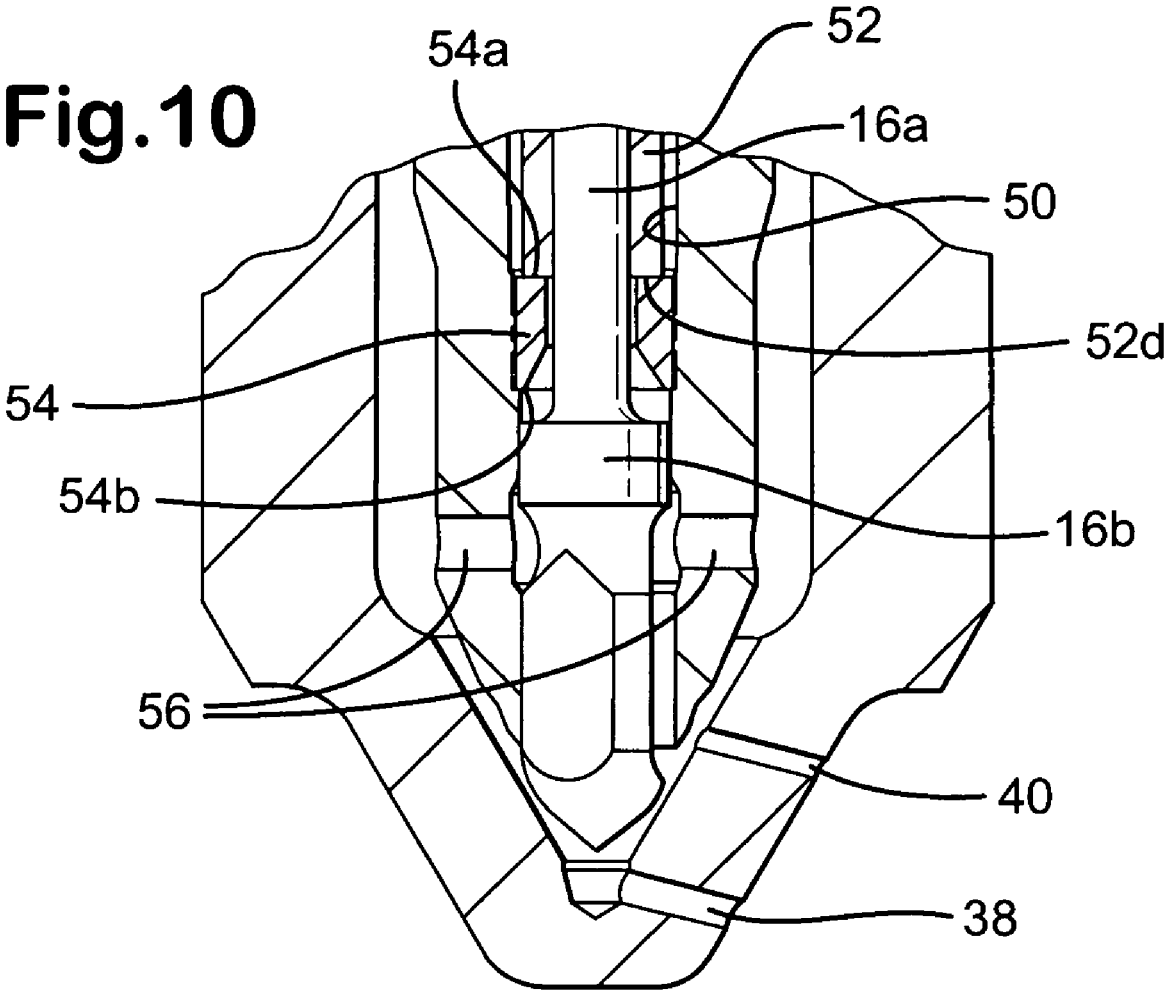

Embodiments of the invention will now be described, by way of example only, with reference to the accompanying drawings in which:

FIG. 1 is a sectional view of an injector provided with an injection nozzle of a first embodiment of the invention, FIG. 2 is a sectional view of the injection nozzle shown in FIG. 1 when in a non-injecting position with the inner and outer valves seated, FIG. 3 is an enlarged sectional view of the injection nozzle as shown in FIG. 2 to illustrate parts more clearly, FIG. 4 is an enlarged view of the outer valve of the injection nozzle in FIGS. 2 and 3, to illustrate first and second valve seats thereof more clearly, FIG. 5 is a sectional view of the injection nozzle as shown in FIGS. 2 to 4 when in a first injecting position in which only the inner valve is open, FIG. 5A is an enlarged view of the injection nozzle in FIG. 5 to illustrate parts more clearly, FIG. 6 is an enlarged sectional view of the injection nozzle as shown in FIG. 5 to illustrate parts more clearly, FIG. 7 is a sectional view of the injection nozzle in FIGS. 2 to 6 when in a second injecting position in which only the outer valve is open, FIG. 8 is an enlarged sectional view of the injection nozzle as shown in FIG. 7 to illustrate parts more clearly, FIG. 9 is a sectional view of the injection nozzle as shown in FIGS. 2 to 8 when in a third injecting position in which both the inner and outer valve needles are open, and FIG. 10 is an enlarged sectional view of the injection nozzle as shown in FIG. 9 to illustrate parts more clearly.

Referring to FIGS. 1 and 2, an injector, referred to generally as 10, includes an injection nozzle, referred to generally as 12, and an actuation means including a piezoelectric actuator 14 for controlling movement of first and second injection nozzle valves, 16 and 18 respectively, by controlling fuel pressure within an injector control chamber 20. The piezoelectric actuator 14 is typically of known type, comprising a stack 22 of piezoelectric elements which are caused to extend and contract upon application of a voltage across the stack 22. It is a feature of the piezoelectric stack 22 that it is housed within a fuel-filled chamber 24 defined within an injector housing part, or injector body 26. The chamber 24 housing the stack 22 defines a part of the fuel supply path between an injector inlet 28 and a supply chamber 30 of the nozzle, the path also being defined by a drilling 32 provided in the upper region of the injector body 26 and a lower region 34 of the chamber 24, as will be described further below. In use, fuel is supplied to the injector inlet 28 from a high pressure fuel source in the form of a common rail or accumulator volume (not shown), and flows through the stack chamber 24 into the nozzle supply chamber 30. Further details of a piezoelectric actuator 14 can be found in the Applicant's European Patent EP 0995901 (Delphi Technologies Inc.).

As can be seen most clearly in FIGS. 2 and 3, the injection nozzle 12 includes a nozzle body 36 provided with first and second outlets, 38 and 40 respectively, which are spaced axially along the main nozzle body axis so that the second outlet 40 adopts a higher axial position along the nozzle body 36 than the first outlet 38. The first outlet 38 is of relatively large diameter to present a relatively large flow area for fuel being injected into the engine, and the second outlet 40 is of relatively small diameter so as to present a lower flow area for fuel being injected into the engine. Only a single first outlet 38 and a single second outlet 40 are shown, but in practice a set of more than one first outlet and a set of more than one second outlet may be provided. For the purpose of the following description, therefore, reference will be made to a set of first outlets 38 and a set of second outlets 40.

The nozzle body 36 is provided with an axially extending blind bore 42 which defines a first, upper delivery chamber 44 for receiving fuel under high pressure from the nozzle supply chamber 30. The axial bore 42 also defines, at its blind end, a second, lower delivery chamber 46 for fuel. Towards its blind end, the internal surface of the bore 42 is of frusto-conical form and here defines a valve seating surface, indicated generally as 48, for both the inner and outer valves 16, 18.

The first and second coaxial valves 16, 18 are arranged concentrically within the bore 42 to allow control of the flow of fuel between the upper delivery chamber 44 and the first and second sets of outlets, 38, 40 respectively. The first valve member takes the form of a first inner valve, or valve needle 16, movement of which controls whether or not fuel is delivered through the first outlets 38. The second valve member takes the form of an outer valve 18, movement of which controls whether or not fuel is delivered through the second outlets 40. The outer valve is in the form of a sleeve having an axially extending through bore 50. The outer valve 18 includes an enlarged region 18*a* at its upper end for co-operation with the adjacent region of the nozzle body bore 42 to guide sliding movement of the outer valve 18, in use. The inner valve needle 16 and the outer valve 18 are engageable with respective seatings, defined by the valve seating, as described further below. In FIGS. 1 to 3, the inner and outer valves 16, 18 are in seated positions, and the injector is said to be in a non-injecting state.

At its upper end, the inner valve needle 16 is coupled to a carrier member 52, referred to as the inner valve carrier member, which extends along the valve bore 50, with the inner valve needle 16 being received within a lower portion of the bore 50. The inner valve needle 16 includes an upper stem 16*a* having a relatively small diameter, which is received within a lower region of the carrier member 52 to couple the parts together in a secure fashion (e.g. by means of a screw thread connection or an interference fit). The inner valve needle 16 is shaped to include a collar 16*b*, either integrally formed therewith or carried as a separate part, which co-operates with the bore 50 in the outer valve 18 so as to guide sliding movement of the inner valve needle 16. The carrier member 52 terminates, at its upper end, in an enlarged head 52*a*.

The inner and outer valves 16, 18 are provided with a coupling means 54 which serves to cause the valves to move together in circumstances in which the outer valve 18 is moved away from its seating 48 beyond a predetermined threshold amount, L. The coupling means includes an annular member, or ring, 54 which is carried in an interference fit by the internal surface of the bore 50 in the outer valve 18, and a lower abutment surface 52*d* of the inner valve carrier member 52 as it moves within the bore 50, in use. The upper surface 54*a* of the ring 54 is engageable with the lower abutment surface 52*d* of the carrier member 52 so that, when the outer valve needle 18 is lifted through an amount which exceeds the amount L (i.e. the gap between the ring 54 and the abutment surface 52*d* when both valves 16, 18 are seated), movement of the outer valve 18 is transmitted to the carrier member 52 and, hence, to the inner valve 16 also. the lower surface 54*b* of the ring 54 defines a stop surface for the collar 16*b* of the inner valve needle 16 so as to limit how far the inner valve needle 16 is able to lift from its seating 48 when the injector is actuated to cause the inner valve needle 16 to move alone.

The outer valve 18 is further provided with radially extending drillings 56, outer ends of which communicate with the upper delivery chamber 44 and inner ends of which communicate with flats or grooves 16*c* provided on the outer surface of the inner valve needle 16. The radially extending drillings 56 and the flats 16*c* together define a flow passage means for allowing fuel to flow between the upper delivery chamber 44 and the lower delivery chamber 46.

The actuation means of the injector further includes a transmitting means for transmitting an actuation force, due to extension or contraction of the piezoelectric stack 22, to the inner and outer valves 16, 18 to permit their independent movement. The transmitting means includes an actuator piston 58, which is carried by an end piece 60 of the piezoelectric stack 22, and the injection control chamber 20 for receiving fuel at injection pressure. The actuator piston 58 takes the form of a sleeve defining a piston bore 62 that defines, at its upper end, a first spring chamber 64 for housing a first, inner valve spring 66. The enlarged head 52*a* of the carrier member 52 is received within the lower portion of the piston bore 62 so that the inner valve spring 66 acts upon it and serves to urge the carrier member 52, and hence the inner valve needle 16, downwards. The spring 66 thus serves to urge the inner valve needle 16 into engagement with its seating 48.

A skirt 68 extends downwardly from the base of the actuator piston 58 to define an enlarged recess for receiving, in a sliding fit, an upper extension 36*a* of the nozzle body 36. The arrangement is such that the lower surface 52*b* of the enlarged head 52*a* of the carrier member 52 faces the upper end surface 18*a* of the outer valve 18. The control chamber 20 of the load transmitting means is therefore defined within the recess by a surface of the actuator piston 58, the upper surface 18*a* of the outer valve 18, the lower surface 52*b* of the enlarged head 52*a* of the carrier member 52 and the upper surface 36*b* of the nozzle body extension 36*a*.

A second spring chamber 70 is defined within an enlarged region of the axially extending bore 50 located at the upper end of the outer valve 18. The second spring chamber 70 houses a second spring 72 which serves to urge the outer valve 18 into engagement with the valve seating 48.

The control chamber 20 communicates with the stack volume 24, 34 through a restrictive flow means in the form of a restricted passage or orifice 74 provided in the skirt 68 of the actuator piston 58. One end of the restricted passage 74 communicates with the control chamber 20 and the other end of the restricted passage 74 communicates with the stack volume 24, 34. The restricted passage 74 ensures fuel pressure within the control chamber 20 tends to equalise with injection pressure at the end of injection, which has advantages for injector operation as will be described further below.

The actuator piston 58 is further provided with a radially extending drilling 76 to provide a communication path between the first spring chamber 64 and the stack chamber 24. If the drilling 76 is of restricted diameter, it provides a means for damping movement of the carrier member 52, and hence of the inner valve needle 16, as discussed further below.

The manner in which the outer valve 18 seats against the valve seating 48 will now be described in further detail with reference to FIG. 4.

The outer valve 18 is shaped to define a first (upper) inner valve seating line 80 located upstream of the second outlets 40 when the valve 18 is seated, and a second (lower) inner valve seating line 82 located downstream of the second outlets 40 when the valve 18 is seated (i.e. one seating line 80, 82 on either side of the outlets 40). The outer valve 18 is provided with a grooved or recessed region 84 to define, at respective upper and lower edges thereof, the upper and lower seating lines 80, 82. The groove 84 is defined by an upper groove region and a lower groove region, both regions being of frusto-conical form and defining, together with the adjacent region of the valve seating 48, an annular volume for fuel at inlet ends of the second outlets 40. Immediately above the upper groove region, the outer valve 18 includes a further region of frusto-conical form.

The upper and lower seating lines 80, 82 of the outer valve 18 engage with the valve seating 48 at respective upper and lower seats thereof, the upper seat being of larger diameter than the lower seat due to its higher axial position along the length of the nozzle body 36.

In the illustration shown, the inner valve needle 16 is provided with an enlarged head, of spherical form, to engage with the valve seating 48. In an alternative embodiment, as depicted in FIG 5A, however, the inner valve needle 16 may engage with the valve seating 48 in a similar manner to that of the outer valve 18, by providing the inner valve needle 16 with a grooved or recessed region to define, at respective upper and lower edges thereof, upper and lower inner valve seating lines for engagement with upper and lower valve seats of the valve seating 48.

Operation of the injector will now be described with reference to FIGS. 5 to 10.

Starting from the position shown in FIGS. 1 to 3, in which both the inner valve needle 16 and the outer valve 18 are urged against their seatings by the springs 66, 72, high pressure fuel fills the stack volume 24, 34 and is supplied to the nozzle supply chamber 30 and the upper delivery chamber 44, but cannot pass the inner and outer valve seatings to reach the first and second outlets 38, 40. Hence, there is no injection into the engine. In the non-injection state, the actuator 14 is held at a first energisation level with an intermediate level voltage applied across the stack. As will be apparent from the following description, the first energisation level shall be referred to as the 'intermediate energisation level'.

In order to inject fuel through the first outlets 38, the actuator 14 is energised to a second, increased energisation level by applying a relatively high voltage across the stack, thereby to increase the length of the stack 22. As a result of stack extension, the actuator piston 58 is moved downwards so as to reduce the volume of the control chamber 20. As the volume of the control chamber 20 is reduced, fuel pressure in the control chamber 20 is increased so that an increased force is applied to the underside surface 52*b* of the enlarged head 52*a* of the carrier member 52. When the force acting on the carrier member 52 (acting in combination with the force applied to the thrust surfaces of the inner valve needle 16 due to fuel pressure within the drillings 56) exceeds the biasing force of the first spring 66, the carrier member 52, together with the inner valve needle 16, is caused to lift in an upwards direction. As the inner valve needle 16 lifts away from the inner valve seating 48, fuel is able to flow through the flow path defined by the drillings 56 and the flats 16*c* into the lower delivery chamber 46 and out through the first outlets 38. This is referred to as the first injecting state of the injector.

It can be seen from the enlarged sectional view of FIG. 6, for example, that the first outlets 38 controlled by the inner valve needle 16 have a relatively large cross sectional flow area compared with the second outlets 40 controlled by the outer valve 18 so that, in the first injecting state, a relatively high fuel delivery rate is achieved.

In the first injecting state, the outer valve 18 remains seated under the force of the second spring 72 and the (increased) force due to fuel pressure within the control chamber 20, both of which serve to maintain the outer valve 18 against the outer valve seating 48. The lower surface 54*b* of the ring 54 therefore defines a stop surface for the inner valve needle 16 to limit the extent of its opening movement, as once the collar 16*b* of the inner valve needle 16 engages the surface 54*b* further movement of the inner valve needle 16 is prevented.

The function of the drilling 76 which allows communication between the first spring chamber 64 and the stack volume 24, 34 is to ensure that opening movement of the inner valve needle 16 is damped. This is because fuel within the spring chamber 64 can only escape through the restricted drilling 76 at a relatively low rate as the carrier member 52 (together with the inner valve needle 16) is moving in the opening direction. As a result of this damping effect, control of movement of the inner valve needle 16 is improved.

From the first injecting state shown in FIGS. 5 and 6, if it is desired to terminate injection the piezoelectric actuator 14 is de-energised to return to its intermediate level by reducing the voltage across the stack so that the length of the stack 22 is contracted or reduced. The actuator piston 58 is therefore moved so as to increase the volume of the control chamber 20 back to its original volume. As the volume of the control chamber 20 increases, fuel pressure in the control chamber 20 is decreased and a point will be reached at which the force of the first spring 66 is sufficient to urge the carrier member 52 and the inner valve needle 16 downwards to re-engage the inner valve needle 16 with its seating.

Fuel is permitted to flow into and out of the control chamber 20, through the restriction 74 provided in the actuator piston 58, in accordance with movement of the inner valve needle 16. The function of the restriction 74 is to ensure that when the actuator 14 is returned to its holding state (intermediate energisation level), the pressure of fuel within the control chamber 20 tends to equalise with fuel pressure within the stack volume 24, 34. In this way, fuel pressure within the control chamber tracks fuel pressure within the stack volume so that all forces remain proportional to injection pressure (i.e. stack volume pressure). Therefore, any rapid change in rail pressure will not result in an unwanted injection. A further advantage of the restriction 74 is that, should the stack fail, the flow through the restriction 74 will allow the needle to close by itself (albeit after a delay which is longer than that of a normal injection). Additionally, by allowing 'fresh' fuel to flow into the control chamber 20, disadvantages associated with the degrading of fuel within the control chamber 20 are avoided.

Referring to FIGS. 7 and 8, if it is desired to inject fuel through only the second outlets 40, as opposed to injecting only through the first outlets 38, the energisation level of the actuator 14 is reduced to a third energisation level, which is less than the intermediate level, by reducing the voltage across the stack. As a result, the length of the stack 22 is reduced to less than the original length so that the actuator piston 58 is moved in a direction to increase the volume of the control chamber 20. As fuel pressure within the control chamber 20 starts to decrease, a point will be reached at which the upward force acting on the outer valve 18 due to fuel within the nozzle supply chamber 30, is sufficient to overcome the force of the second spring 72 and the outer valve 18 will lift from its seating. As fuel pressure within the control chamber 20 is now reduced, there is an insufficient lifting force acting on the head 52*a* of the carrier member 52 to lift the inner valve needle 16 from its seating. Furthermore, the energisation level of the stack 22 is only reduced to a level at which the outer valve 18 is caused to lift through an amount less than the distance, L, so that there is no coupling of the outer valve's movement to the inner valve needle 16 whilst the surfaces 54*a*, 52*d* of the ring 54 and the carrier member 52 remain disengaged. This is referred to as the second fuel injection state in which fuel injection only takes place through the second outlets 40. It will be appreciated that as the size of the second outlets 40 is less than that of the first outlets 38, the fuel delivery rate for the second injection state is relatively low compared with that for the first injection state.

Injection through the second outlets 40 can be terminated by re-energising the stack 22 so as to restore its original length (i.e. energising the stack 22 to the intermediate level once again). This re-establishes fuel pressure within the control chamber 20 to a sufficiently high level to seat the outer valve 18, but not to cause the inner valve needle 16 to lift.

It is one benefit of providing upper and lower valve seats for the outer valve 18 that the quantity of fuel that can flow to the second outlets 40 for a given needle lift is substantially increased by virtue of there being two flow paths for fuel between the upper delivery chamber 44 and the outlets 40; a first flow path directly past the upper portion of the outer valve seating 48 and a second flow path through the drillings 56 and the flats 16*c* of the inner valve needle 16 and past the lower portion of the outer valve seating 48. An additional benefit is obtained as, due to the flow into the inlet ends of the outlets 40 from both upstream and downstream directions, a more uniform or substantially symmetric flow of fuel to the outlets is achieved to improve fuel spray balance into the combustion chamber.

Referring to FIGS. 9 and 10, if it is desired to inject fuel through both the first and second outlets 38, 40 at the same time, the actuator 14 may be de-energised to a fourth energisation level, which is lower than the third energisation level, by reducing the voltage across the stack still further. As a result, the stack length is decreased to an even shorter length and the actuator piston 58 is caused to move upwards through an amount which increases the volume of the control chamber 20 still further. Fuel pressure within the control chamber 20 is therefore decreased to a further reduced amount (i.e. lower than that for the second injecting state).

By de-energising the stack 22 to the fourth, lowest energisation level, the pressure in the control chamber 20 is reduced sufficiently to allow the outer valve 18 to move through a further amount which exceeds the distance L. As a consequence, the abutment surface 54*a* of the ring 54 is caused to engage with the abutment surface 52*d* of the carrier member 52, so that further movement of the outer valve 18 away from the outer valve seating 48 causes movement to be transmitted to the inner valve needle 16 also, via the engaged surfaces 54*a*, 52*d*. In this third injection state, fuel injection occurs through both the first and second outlets 38, 40 at the same time and, thus, at a third, higher injection rate.

In order to terminate injection from the third injecting position, the actuator stack 22 must be returned to its original holding state to allow fuel pressure within the control chamber 20 to decrease sufficiently for both valves 16, 18 to be urged to close by means of the springs 66, 72.

The ability to inject at three different injection rates provides the particular advantage that low, medium and high fuel injection rates can be achieved for engine operation at low, medium and high engine loads respectively. In addition, as it is possible to inject through either the first outlets 38 or the second outlets 40 independently, it is possible to operate effectively in both HCCI and conventional diesel modes without compromise. Having said this, the cone angles of the sprays from the first and second outlets 38, 40 are preferably selected to have a small angle difference (i.e. the difference between the included cone angle of the spray from the first outlets 38 is similar to the included cone angle of the spray from the second outlets 40), as larger differences are not seen to provide advantageous results when the two sprays combine (i.e. injection through both sets of outlets 38, 40).

The invention provides a further advantage over known injectors in which the actuator voltage level (energisation level) is high when the injector is in a non-injecting condition (being that condition that the injector is in most of the time). In the present invention, the voltage is held at an intermediate level for non-injecting conditions, and is only switched to a high energisation level when it is required to lift the inner valve needle 16 to inject through the first outlets 38 only. The period of time for which the injector is at a high energisation level is therefore reduced and, thus, actuator lifetime is enhanced.

If it is not required to switch rapidly between different injection modes the injector may be operated in a different manner, by gradually changing the voltage level that is held between injection events (i.e. the non-injecting state). When the next injection is to be through the first outlets 38 by switching to 'voltage high' to lift the inner valve needle 16, the holding voltage level may tend towards zero during the non-injecting condition. When the next injection is to be through the second outlets 40 by switching to 'voltage low' to lift the outer valve needle 18, the holding voltage level may tend towards a high voltage level during the non-injecting condition. This mode of operation is possible by virtue of the restricted flow passage 74 between the stack volume 24, 34 and the control chamber 20 maintaining the control chamber 20 at the intermediate pressure level, providing the actuator voltage is not changed too rapidly.

Although the aforementioned embodiments describe injectors in which a piezoelectric actuator is used to control pressure within a control chamber 20, it is also envisaged that alternative actuation means may be provided to achieve the same effect, such as a magnetostrictive actuator means. In other embodiments, the spring 72 for the outer valve needle 18 may also be removed.

The invention claimed is:

1. A fuel injector for an internal combustion engine, the injector comprising:

a nozzle body provided with a nozzle bore, an inner valve which is engageable with an inner valve seating to control fuel delivery through one or more first nozzle outlet, an outer valve which is received within the nozzle bore and engageable with an outer valve seating to control fuel delivery through one or more second nozzle outlet, an arrangement for controlling movement of the inner and outer valves, including a control chamber for fuel and an actuator for facilitating transmission of an actuation force to the inner and outer valves so as to permit movement of either the inner valve only to provide a first injection state in which fuel is delivered through only said first outlet, or movement of the outer valve only to provide a second injection state in which fuel is delivered through only said second outlet, and a coupling arrangement for coupling movement of the outer valve to the inner valve in circumstances in which the outer valve is moved away from the outer valve seating through an amount exceeding a predetermined threshold amount, thereby to cause the inner valve to lift away from the inner valve seating to provide a third injection state in which fuel is delivered through both the first and the second nozzle outlets together, wherein a first surface associated with the inner valve is exposed to fuel pressure within the control chamber and a second surface associated with the outer valve is exposed to fuel pressure within the control chamber.

2. A fuel injector for an internal combustion engine, the injector comprising:

a nozzle body provided with a nozzle bore, an inner valve which is engageable with an inner valve seating to control fuel delivery through one or more first nozzle outlet, an outer valve which is received within the nozzle bore and engageable with an outer valve seating to control fuel delivery through one or more second nozzle outlet, an arrangement for controlling movement of the inner and outer valves, including a control chamber for fuel and an actuator for transmitting an actuation force to the inner and outer valves so as to permit movement of either the inner valve only to provide a first injection state in which fuel is delivered through only said first outlet, or movement of the outer valve only to provide a second injection state in which fuel is delivered through only said second outlet, and a coupling arrangement for coupling movement of the outer valve to the inner valve in circumstances in which the outer valve is moved away from the outer valve seating through an amount exceeding a predetermined threshold amount, thereby to cause the inner valve to lift away from the inner valve seating to provide a third injection state in which fuel is delivered through both the first and the second nozzle outlets together including a control chamber for fuel through which the actuation force is transmitted to the inner and outer valves, a first surface associated with the inner valve being exposed to fuel pressure within the control chamber and a second surface associated with the outer valve having a second surface exposed to fuel pressure within the control chamber.

3. The injector as claimed in claim 2, wherein the first and second surfaces are arranged such that an increase in fuel pressure within the control chamber causes one of the inner or outer valves to lift away from its seating and a decrease in fuel pressure within the control chamber causes the other of the inner or outer valves to lift away from its seating.

4. The injector as claimed in claim 3, wherein the control chamber is configured relative to the inner and outer valves so that an increase in fuel pressure within the control chamber results in the inner valve being moved away from its seating and a decrease in fuel pressure within the control chamber results in the outer valve being moved away from its seating.

5. The injector as claimed in claim 2, wherein the outer valve is provided with a valve bore within which the inner valve is received and wherein the inner valve is coupled to a carrier member which extends through the valve bore provided in the outer valve to define the first surface.

6. The injector as claimed in claim 2, wherein the inner valve defines the first surface.

7. The injector as claimed in claim 5, wherein the coupling arrangement includes an abutment surface defined by, and/or movable with, the outer valve, wherein the abutment surface is engageable with a co-operable surface defined by the carrier member.

8. The injector as claimed in claim 7, wherein the abutment surface is defined by an annular member received within the valve bore.

9. The injector as claimed in claim 2, wherein the actuator is a piezoelectric actuator including a stack of piezoelectric elements arranged within a stack chamber for receiving fuel at injection pressure, whereby an increase in the length of the stack results in an increase in pressure within the control chamber and a decrease in the length of the stack results in a decrease in pressure within the control chamber.

10. The injector as claimed in claim 9, wherein the actuator is coupled to an actuator piston having a piston surface, the control chamber being defined, at least in part, by the first and second surfaces associated with the inner and outer valves, respectively, and by the piston surface.

11. The injector as claimed in claim 10, further including a damping arrangement for damping opening movement of the inner valve away from the inner valve seating.

12. The injector as claimed in claim 11, further including a spring chamber housing a spring which serves to bias the inner valve towards the inner valve seating, wherein the damping arrangement includes a restricted passage defined within the actuator piston which connects the spring chamber to the stack chamber.

13. The injector as claimed in claim 12, further including a restrictive flow path for connecting the control chamber to the stack chamber so as to equalise fuel pressure within the control chamber with fuel pressure within the stack chamber at the end of injection.

14. The injector as claimed in claim 13, wherein the restrictive flow path is a restricted flow passage provided in the actuator piston.

15. A fuel injector for an internal combustion engine, the injector comprising:

a nozzle body provided with a nozzle bore, an inner valve which is engageable with an inner valve seating to control fuel delivery through one or more first nozzle outlet, an outer valve which is received within the nozzle bore and engageable with an outer valve seating to control fuel delivery through one or more second nozzle outlet, an arrengement for controlling movement of the inner and outer valves, including a control chamber for fuel and an actuator for transmitting an actuation force to the inner and outer valves so as to permit movement of either the inner valve only to provide a first injection state in which fuel is delivered through only said first outlet, or movement of the outer valve only to provide a second injection state in which fuel is delivered through only said second outlet, and a coupling arrangement for coupling movement of the outer valve to the inner valve in circumstances in which the outer valve is moved away from the outer valve seating through an amount exceeding a predetermined threshold amount, thereby to cause the inner valve to lift away from the inner valve seating to provide a third injection state in which fuel is delivered through both the first and the second nozzle outlets together, wherein the outer valve is provided with upper and lower seating lines, spaced one on either side of said second outlet in circumstances in which the outer valve is seated, wherein the upper and lower seating lines are engageable with respective upper and lower seats of the outer valve seating.

16. A fuel injector for an internal combustion engine, the injector comnrising:

a nozzle body provided with a nozzle bore, an inner valve which is engageable with an inner valve seating to control fuel delivery through one or more first nozzle outlet, an outer valve which is received within the nozzle bore and engageable with an outer valve seating to control fuel delivery through one or more second nozzle outlet, an arrangement for controlling movement of the inner and outer valves, including a control chamber for fuel and an actuator for transmitting an actuation force to the inner and outer valves so as to permit movement of either the inner valve only to provide a first injection state in which fuel is delivered through only said first outlet, or movement of the outer valve only to provide a second injection state in which fuel is delivered through only said second outlet, and a coupling arrangement for coupling movement of the outer valve to the inner valve in circumstances in which the outer valve is moved away from the outer valve seating through an amount exceeding a predetermined threshold amount, thereby to cause the inner valve to lift away from the inner valve seating to provide a third injection state in which fuel is delivered through both the first and the second nozzle outlets together, wherein the inner valve is provided with upper and lower seating lines, spaced one on either side of said first outlet in circumstances in which the inner valve is seated, wherein the upper and lower seating lines are engageable with upper and lower seats, respectively, of the inner valve seating.

17. The injector as claimed in claim 16, wherein the upper and lower seating lines of the inner valve are defined by upper and lower edges, respectively, of a groove provided on the inner valve, said groove comprising an upper groove region of frusto-conical form to define the upper edge and a lower groove region of frusto-conical form to define the lower edge.

18. The injector as claimed in claim 15, wherein the upper and lower seating lines of the outer valve are defined by upper and lower edges, respectively, of a groove provided on the outer valve, the groove comprising an upper groove region of frusto-conical form to define the upper edge and a lower groove region of frusto-conical form to define the lower edge.

19. A fuel injector for an internal combustion engine, the injector comprising:

a nozzle body provided with a nozzle bore, an inner valve which is engageable with an inner valve seating to control fuel delivery through one or more first nozzle outlet, an outer valve which is received within the nozzle bore and engageable with an outer valve seating to control fuel delivery through one or more second nozzle outlet, an arrangement for controlling movement of the inner and outer valves, including a control chamber for fuel and an actuator for transmitting an actuation force to the inner and outer valves so as to permit movement of either the inner valve only to provide a first injection state in which fuel is delivered through said first outlet, or movement of the outer valve only to provide a second injection state in which fuel is delivered through only said second outlet, and a coupling arrangement for coupling movement of the outer valve to the inner valve in circumstances in which the outer valve is moved away from the outer valve seating through an amount exceeding a predetermined threshold amount, thereby to cause the inner valve to lift away from the inner valve seating to provide a third injection state in which fuel is delivered through both the first and the second nozzle outlets together, wherein the nozzle bore defines an upper delivery chamber for delivering fuel to the first and second outlets and a lower delivery chamber for delivering fuel to the first and second outlets, wherein the inner valve defines, at least in part, a flow passage to allow fuel to flow from the upper delivery chamber towards the lower delivery chamber.

20. The injector as claimed in claim 19, wherein the flow passage includes one or more flat provided on the outer surface of the inner valve.

21. The injector as claimed in claim 1, wherein said first outlet has a different cross sectional flow area compared with said second outlet.

22. A fuel injector for an internal combustion engine, the injector comprising:

an inner valve which is engageable with an inner valve seating to control fuel delivery through one or more first nozzle outlet, an outer valve which is engageabie with an outer valve seating to control fuel delivery through one or more second nozzle outlet, an actuator for facilitating transmission of an actuation force to the inner and outer valves so as to permit movement of either the inner valve only to provide a first injection state in which fuel is delivered through only said first outlet, or movement of the outer valve only to provide a second injection state in which fuel is delivered through only said second outlet, and a coupling arrangement for coupling movement of the outer valve to the inner valve in circumstances in which the outer valve is moved away from the outer valve seating through an amount exceeding a predetermined threshold amount, so as to cause the inner valve to lift away from the inner valve seating to provide a third injection state in which fuel is delivered through both the first and the second nozzle outlets together, wherein the outer valve is provided with a valve bore within which the inner valve is received, and a control chamber for fuel, a first surface associated with the inner valve being exposed to fuel pressure within the control chamber and a second surface associated with the outer valve having a second surface exposed to fuel pressure within the control chamber.

23. A fuel injector for an internal combustion engine, the injector comprising:

an inner valve which is engageable with an inner valve seating to control fuel delivery through, one or more first nozzle outlet, an outer valve which is engageable with an outer valve seating to control fuel delivery through one or more second nozzle outlet, an actuator for transmitting an actuation force to the inner and outer valves so as to permit movement of either the inner valve only to provide a first injection state in which fuel is delivered through only said first outlet or movement of the outer valve only to provide a second injection state in which fuel is delivered through only said second outlet, and a coupling arrangement for coupling movement of the outer valve to the inner valve in circumstances in which the outer valve is moved away from the outer valve seating through an amount exceeding a predetermined threshold amount, so as to cause the inner valve to lift away from the inner valve seating to provide a third injection state in which fuel is delivered through both the first and the second nozzle outlets together. wherein the outer valve is provided with a valve bore within which the inner valve is received, further including a damping arrangement for damping opening movement of the inner valve away from the inner valve searing.

24. A fuel injector for an internal combustion engine, the injector comprising:

an inner valve which is engageable with an inner valve seating to control fuel delivery through one or more first nozzle outlet, an outer valve which is engageable with an outer valve seating to control fuel delivery though one or more second nozzle outlet, a control chamber for fuel, a first surface associated with the inner valve being exposed to fuel pressure within the control chamber and a second surface associated with the outer valve having a second surface exposed to fuel pressure within the control chamber, an actuator for transmitting an actuation force to the inner and outer valves, via the control chamber, so as to permit movement of either the inner valve only to provide a first injection state in which fuel is delivered through only said first outlet, or movement of the outer valve only to provide a second injection state in which fuel is delivered through only said second outlet, and a coupling between the outer valve and the inner valve so that in circumstances in which the outer valve is moved away from the outer valve seating through an amount exceeding a predetermined threshold amount, movement of the outer valve is transmitted to the inner valve so as to provide a third injection state in which fuel is delivered through both the first and the second nozzle outlets together.

25. The injector as claimed in claim 24, wherein the actuator is a piezoelectric actuator including a stack of piezoelectric elements arranged within a stack chamber for receiving fuel at injection pressure, whereby an increase in the length of the stack results in an increase in pressure within the control chamber and a decrease in the length of the stack results in a decrease in pressure within the control chamber.

* * * * *